US009453320B1

(12) United States Patent
Peraza

(10) Patent No.: US 9,453,320 B1
(45) Date of Patent: Sep. 27, 2016

(54) ANCHOR ASSEMBLAGE AND ANCHORAGE SYSTEM FOR SECURING ITEMS ON A SANDY BEACH

(71) Applicant: Rogelio Peraza, Pembroke Pines, FL (US)

(72) Inventor: Rogelio Peraza, Pembroke Pines, FL (US)

( * ) Notice: Subject to any disclaimer, the term of this patent is extended or adjusted under 35 U.S.C. 154(b) by 0 days.

(21) Appl. No.: 14/829,837

(22) Filed: Aug. 19, 2015

(51) Int. Cl.
*E02D 5/80* (2006.01)
*A47G 9/06* (2006.01)

(52) U.S. Cl.
CPC ..... *E02D 5/80* (2013.01); *A47G 9/062* (2013.01)

(58) Field of Classification Search
CPC ..... E02D 5/80; E02D 5/54; E04H 15/32; E04H 12/2215; E04H 12/2292; A47G 9/062
USPC ..... 52/155–156, 166, 169.7, 169.13, 170; 248/500, 508, 510, 519, 530, 545, 156; 135/16; 5/417, 658
See application file for complete search history.

(56) References Cited

U.S. PATENT DOCUMENTS 4,850,564 A * 7/1989 Padin ..... E04H 12/2223 248/156
5,245,715 A * 9/1993 Dinkins ..... E04H 15/62 135/118
5,452,877 A * 9/1995 Riffle ..... E04H 12/2246 135/16
5,520,364 A * 5/1996 Bloxson ..... A47G 9/062 248/500
5,636,944 A * 6/1997 Buttimore ..... E01F 9/0117 248/530
6,164,613 A * 12/2000 Williams ..... E04H 12/2246 248/533
6,226,813 B1 * 5/2001 Wilburn ..... A47G 9/062 135/118
6,446,649 B1 * 9/2002 Bigford ..... A45B 23/00 135/16
6,631,527 B2 * 10/2003 Hyduk ..... A45F 3/44 135/118
7,168,437 B2 * 1/2007 Bigford ..... A45B 23/00 135/16
8,444,105 B2 * 5/2013 Silvestri ..... E04H 12/2215 248/156
9,232,836 B1 * 1/2016 Zaccaro ..... E02D 5/80
2012/0126089 A1 * 5/2012 Silvestri ..... E04H 12/2215 248/530

* cited by examiner

*Primary Examiner* — Beth Stephan
(74) *Attorney, Agent, or Firm* — Glenn E. Gold, P.A.

(57) ABSTRACT

An anchorage system includes a plurality of anchors, disassembled from an anchor assemblage, and a plurality of anchor connectors. Each anchor includes a body having an endless rigid sidewall defining and surrounding an interior cavity in the body. The sidewall has an endless rim and an attachment formation opposite from the endless rim. Each anchor connector is configured to couple with the attachment formation on the sidewall of the anchor and engage a sheet of material, such as a beach towel, at one of a plurality of corners thereof so as to secure the sheet of material on the sandy beach when the anchor bodies are buried in the sandy beach such that the interior cavities of the anchor bodies, below the endless rims thereof, are substantially filled with sand.

19 Claims, 17 Drawing Sheets

ANCHOR ASSEMBLAGE AND ANCHORAGE SYSTEM FOR SECURING ITEMS ON A SANDY BEACH

FIELD OF THE INVENTION

The present invention relates to recreational accessories, and more particularly, is concerned with an anchor assemblage and anchorage system for securing items on a sandy beach.

BACKGROUND OF THE INVENTION

Relaxing on a sandy beach is one of the most popular leisure activities of millions of people. Beach towels are typically spread out on the sand for persons to sit or lie on. Also, one or more large umbrellas are oftentimes lodged or planted adjacent to the towels to provide shade from the sun when desired.

However, towels and umbrellas are vulnerable to disruption by breezes that arise from time to time. Corners of the towels are frequently lifted and folded over onto the remainder of the towel and persons thereon. The umbrellas may become dislodged and roll or fall over so as to turn into a hazard to persons located nearby. Approaches to anchoring beach towels and umbrellas so as to reduce their vulnerability to disruption have been proposed from time to time but thus far none have appeared to provide a completely satisfactory solution.

Accordingly, there remains a need in the art for an innovation that will overcome the deficiencies of past approaches and the problems that remain unsolved.

SUMMARY OF THE INVENTION

The present invention overcomes the deficiencies of the known art and the problems that remain unsolved by providing an anchor assemblage and anchorage system for securing items on a sandy beach.

In one aspect of the present invention, an anchor assemblage includes:

- a plurality of anchors, each anchor including
  - a body in the form of an endless rigid sidewall defining and surrounding an interior cavity in the body, the sidewall having an endless rim, and
  - an attachment formation on the sidewall opposite from the endless rim for coupling with an anchor connector configured to engage with an item on a sandy beach so as to secure the item on the sandy beach when the anchor body is buried in the sandy beach such that the interior cavity of the anchor body, below the endless rim thereof, is substantially filled with sand;
- wherein the plurality of anchors form an anchor assemblage including a first pair of anchors and a second pair of anchors, each anchor of the first pair being of a first size and each anchor of the second pair being of a second size greater than the first size, the anchors of the first pair at the endless rims thereof being complementarily configured so as to enable the anchors of the first pair to interengage with one another at the endless rims thereof and the anchors of the second pair at the endless rims thereof being complementarily configured so as to enable the anchors of the second pair to interengage with one another at the endless rims thereof such that the first and second interengaged pairs of anchors respectively form into configurations having two different sizes which enable fitting the first pair of anchors into the second pair of anchors for facilitating their transport together to and from the sandy beach and their compact storage when not in use.

In another aspect of the present invention, the endless rims of the sidewalls of the first and second pairs of anchors have complementary sets of threads defined thereon that enable the anchors of a respective pair thereof to interengage with one another. Also, the attachment formation on each of the anchors of the second pair thereof is a hub formed on the anchor sidewall opposite from the endless rim so as to extend into the interior cavity of the anchor body, the hub having a set of threads about an exterior portion thereof. Further, the attachment formation on each of the anchors of the first pair thereof is an annular protuberance formed on the anchor sidewall opposite from the endless rim so as to extend into the interior cavity of the anchor body and receive the hub of an adjacent one the second pair of anchors.

In another aspect of the present invention, the anchors of the second pair thereof have pluralities of ribs formed in the sidewalls thereof as to extend into the interior cavities of the anchor bodies and between the endless rims and the attachment formations on the sidewalls opposite from the endless rims, the ribs enabling nesting of the first pair of anchors within the second pair of anchors in a predetermined alignment of the first and second pairs with one another.

In another aspect of the present invention, each of the endless sidewalls of the anchor bodies of the anchor assemblage is semi-spherical shaped, and each of the endless rims is circular shaped. Also, each of the interengaged anchors of the first and second pairs respectively form into configurations of globes having the two different sizes.

In another aspect of the present invention, an anchorage system includes:

- a plurality of anchors, each anchor including
  - a body having an endless rigid sidewall defining and surrounding an interior cavity in the body, the sidewall having an endless rim, and
  - an attachment formation on the endless sidewall opposite from the endless rim; and
- a plurality of anchor connectors each being configured to couple with one of the attachment formations on the sidewalls of the anchors and engage a sheet of material at one of a plurality of corners thereof so as to secure the sheet of material on the sandy beach when the anchor bodies are buried in the sandy beach such that the interior cavities of the anchor bodies, below the endless rims there, are substantially filled with sand.

In another aspect of the present invention, the plurality of anchors form an anchor assemblage including a first pair of anchors and a second pair of anchors, each anchor of the first pair being a first size and each anchor of the second pair being of a second size greater than the first size, the anchors of the first pair at the endless rims thereof being complementarily configured so as to enable the anchors of the first pair to interengage with one another at the endless rims thereof and the anchors of the second pair at the endless rims thereof being complementarily configured so as to enable the anchors of the second pair to interengage with one another at the endless rims thereof such that the first and second interengaged pairs of anchors respectively form into configurations of two different sizes which enable fitting the first pair of anchors into the second pair of anchors for facilitating their transport together to and from the sandy beach and their compact storage when not in use.

In another aspect of the present invention, each of the endless sidewalls of the anchor bodies of the anchorage system is semi-spherical shaped and each of the endless rims is circular shaped. Also, each of the interengaged anchors of the first and second pairs respectively form into configurations of globes having the two different sizes.

In another aspect of the present invention, an anchorage system includes:

at least one anchor, the anchor including a body having an endless rigid sidewall defining and surrounding an interior cavity in the body, the sidewall having an endless rim and a central opening opposite from the endless rim, and an attachment formation on the sidewall extending about the central opening therein; and at least one anchor connector, the anchor connector being configured to couple to at one end to the attachment formation on the anchor sidewall so as to close the central opening in the anchor sidewall and extend through the interior cavity of the anchor body to outwardly beyond the endless rim of the anchor sidewall, the anchor connector also being configured to engage with an item so as to secure the item on a sandy beach when the anchor body is buried in the sandy beach such that the interior cavity of the anchor body, below the endless rim thereof, is substantially filled with sand.

In another aspect of the present invention, the attachment formation includes an annular cap attached, one of either removably or permanently, to and extending about the central opening of the anchor sidewall, the annular cap having an aperture. The anchor connector includes a flexible line having a plug on one end thereof being attached, one of either removably or permanently, to the annular cap so as to close the aperture of the annular cap. The anchor connector also includes a clamp coupled to another end of the flexible line opposite from the one end, the clamp being configured to detachably grasp a portion of the item so as to secure the item on the sandy beach.

In another aspect of the present invention, the attachment formation includes a hub formed on the anchor sidewall about the central opening therein and extending within the interior cavity of the anchor body, the hub having an exteriorly-threaded portion. The anchor connector includes a flexible line having a socket on one end thereof, the socket having an internally-threaded portion being detachably attachable to the exteriorly-threaded portion of the hub on the anchor sidewall. The anchor connector also includes a clamp coupled to another end of the flexible line opposite from the one end, the clamp being configured to detachably grasp a portion of the item so as to secure the item on the sandy beach.

In another aspect of the present invention, the anchor connector includes an elongated sleeve having another end, being opposite to the one end, mounting an object at the another end being different in shape than the sleeve and having a hook element thereon being exposed above the sandy beach for attachment of another item thereto when the anchor body is buried in the sandy beach.

In another aspect of the present invention, the anchor connector includes an elongated sleeve having another end being opposite to the one end, the elongated sleeve defining a hollow interior configured for receiving an end portion of pole of a beach umbrella through the another end and into the hollow interior of the elongated sleeve. The anchor connector also has a knob threaded through a threaded opening in a side of the elongated sleeve for tightening and loosening against the end portion of the pole of the beach umbrella for securing and releasing the pole to and from the elongated sleeve.

In another aspect of the present invention, the anchor connector at the one end and the attachment formation about the central opening on the anchor sidewall have sets of protrusions and recesses defined thereon that are complementary to one another so as to enable the anchor connector to couple with the attachment formation. Also, the endless sidewall of the anchor body is semi-spherical shaped, and the endless rim on the endless sidewall is circular shaped.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Figure 1:
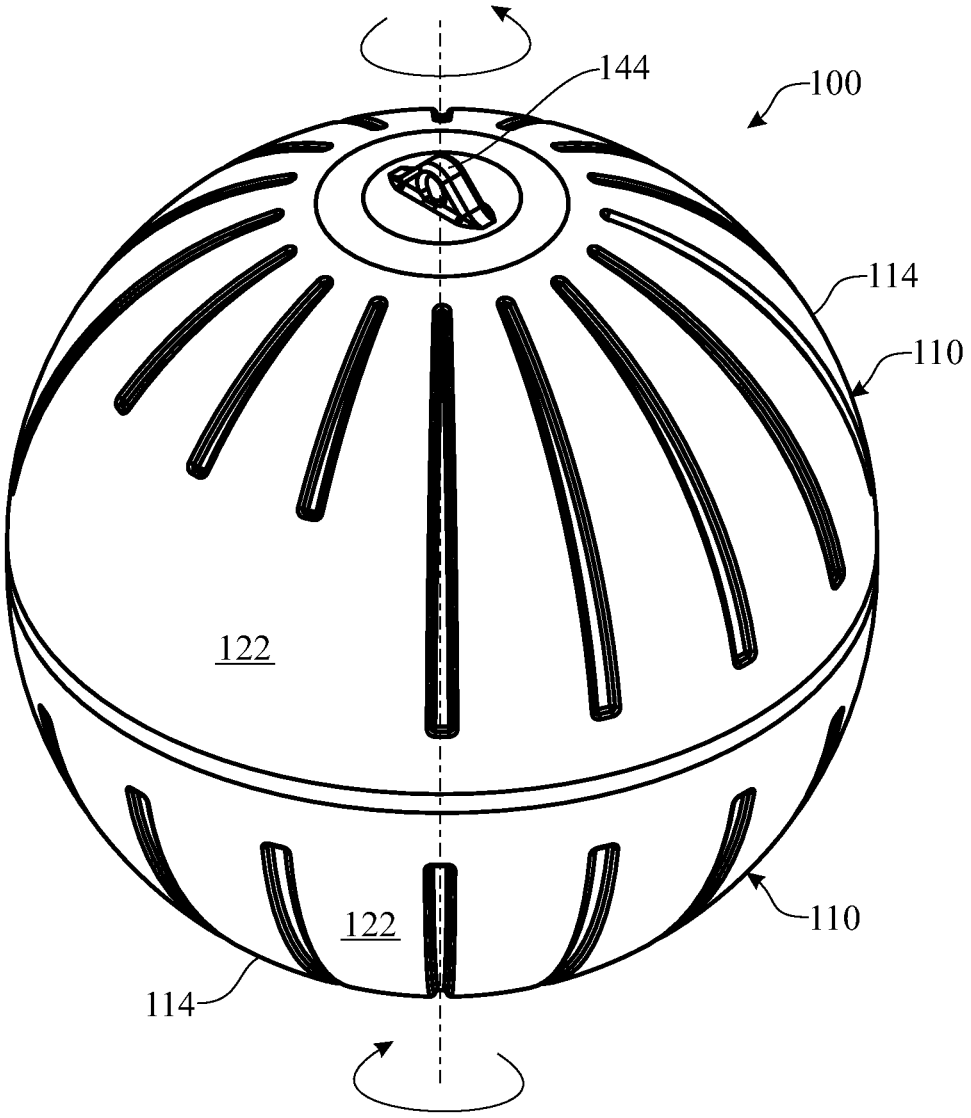
FIG. 1 presents a top isometric view of an exemplary embodiment of a plurality of anchors used by an anchorage system for securing an item, such as a beach towel, on a sandy beach, the anchors being shown threaded together in a fully assembled configuration facilitating their transport or storage.
Figure 2:
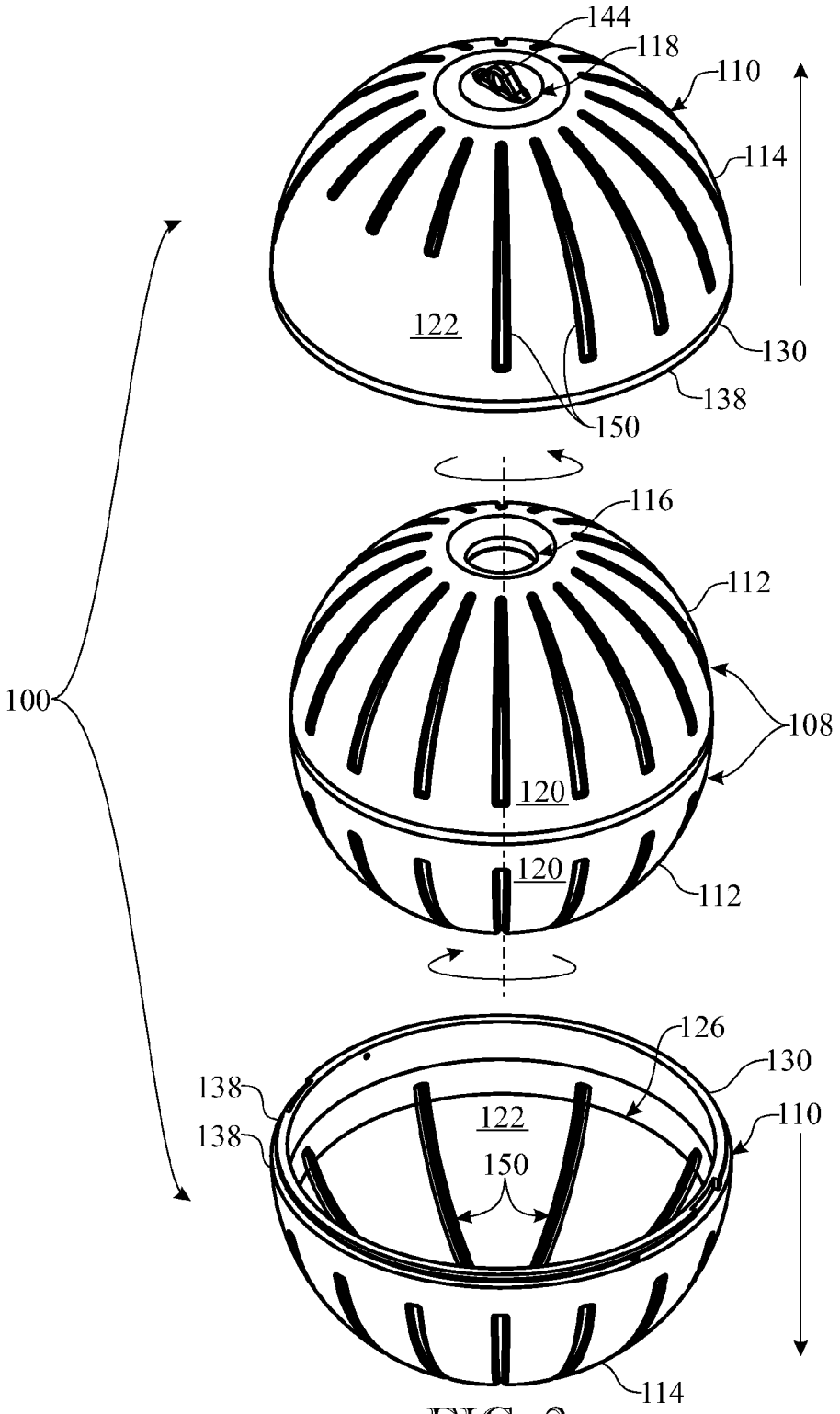
FIG. 2 presents a top isometric view of the anchors originally introduced in FIG. 1, wherein an exterior pair of the anchors are now shown unthreaded from one another and un-nested from an interior pair of the anchors.
Figure 3:
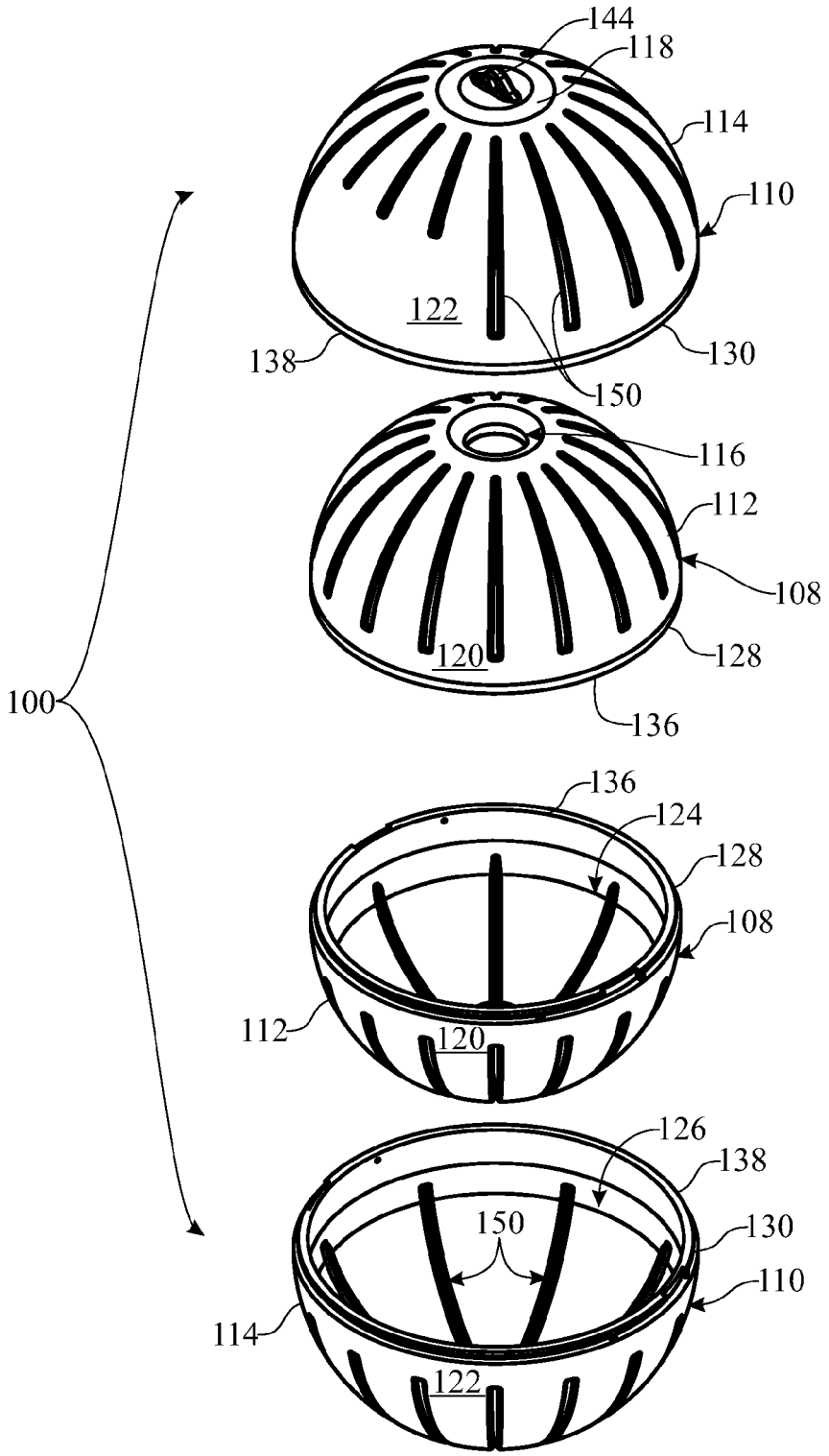
FIG. 3 presents a top isometric view of the anchors originally introduced in FIG. 1, wherein the exterior anchors are shown in the same relationship to one another as in FIG. 2 while the interior anchors are now also shown unthreaded from one another.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 9:
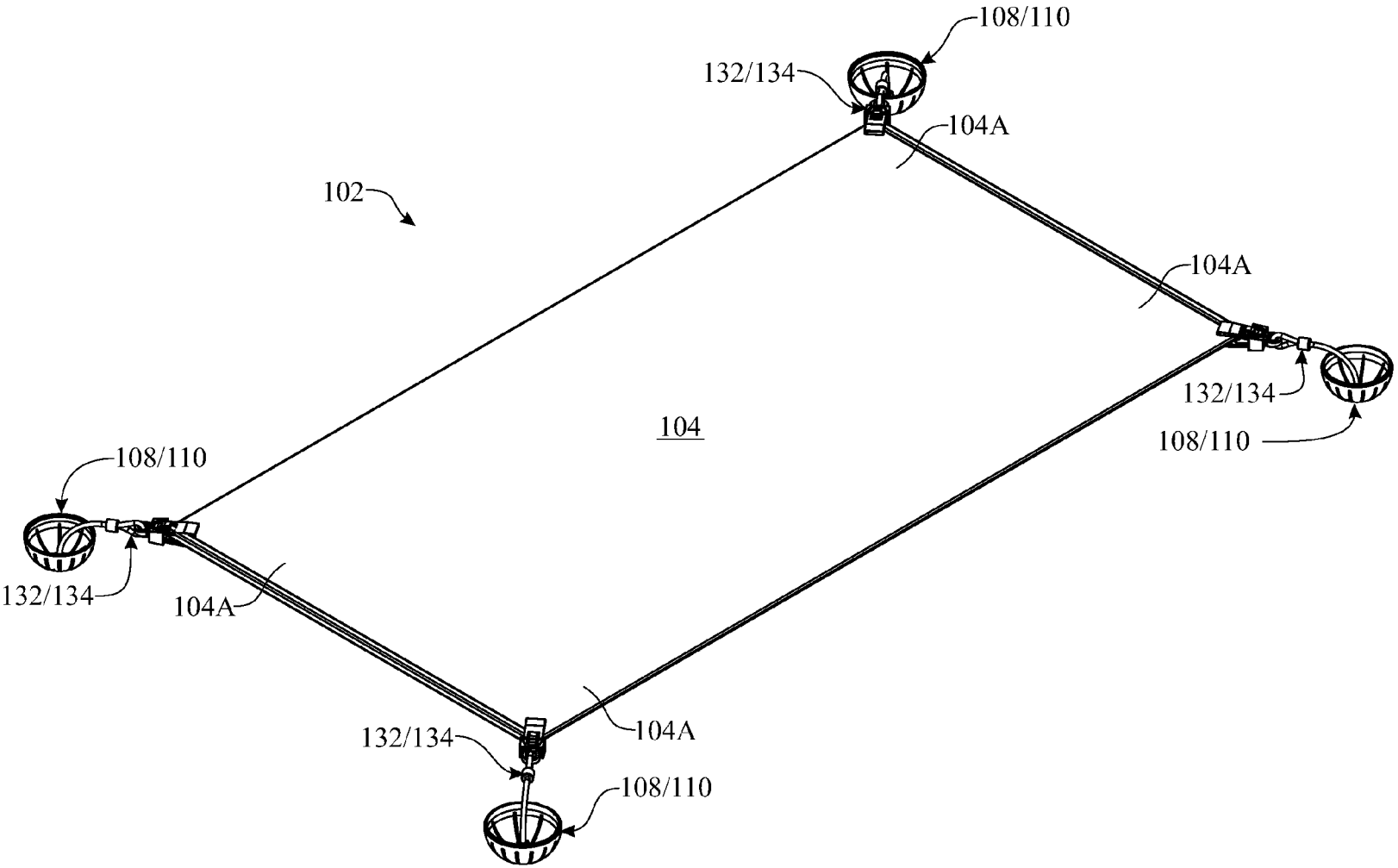
FIG. 9 presents a top isometric view of an exemplary embodiment of an anchorage system having four anchors and four anchor connectors extending between and respectively coupled with the four anchors and engaged with respective corners of a beach towel so as to secure the towel on the sandy beach.
Figure 10:
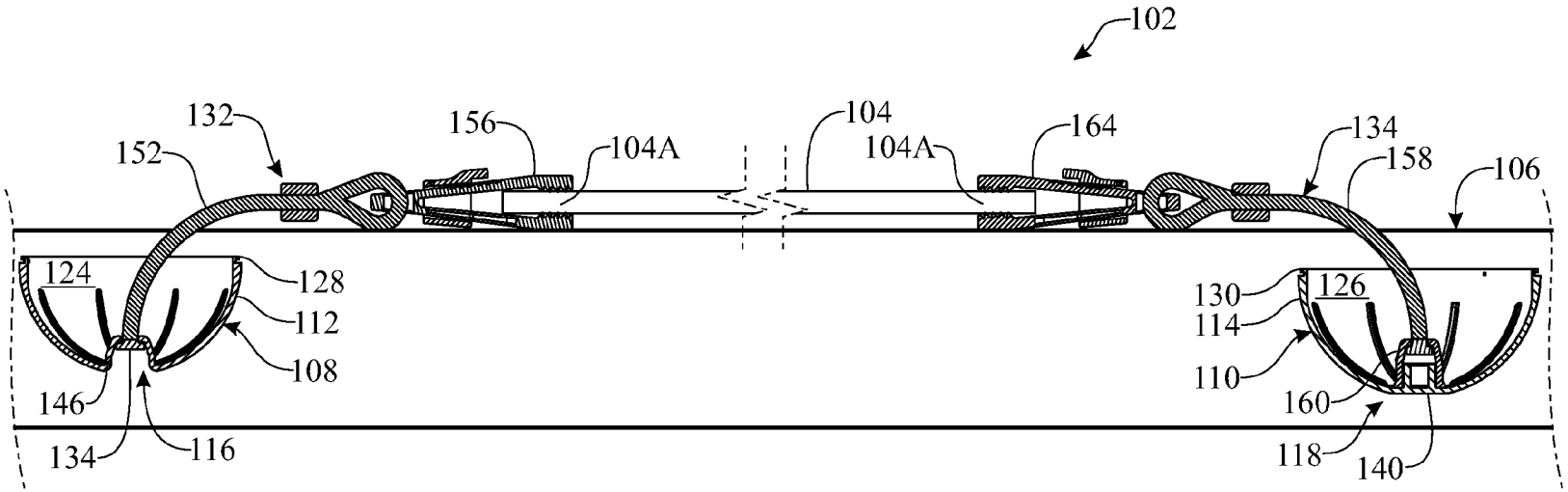
FIG. 10 presents a longitudinal sectional view of any two of the four anchors and anchor connectors of the anchorage system of FIG. 9 being connected at any two of the corners at opposite ends of any one of the sides of the beach towel so as to secure the towel on the sandy beach.

Referring now to FIGS. 1-4, there is illustrated an exemplary embodiment of an anchor assemblage, generally designated 100. As one example, the anchor assemblage 100 may form part of an anchorage system, generally designated 102, as illustrated in FIGS. 9 and 10, securing an item, such as a sheet of material 104 with one example being a beach towel, on a sandy beach 106. The anchor assemblage 100 basically has a plurality of anchors, preferably being four in number. More particularly, the anchor assemblage 100 includes a first pair of the anchors in the plurality, being interior anchors 108, and a second pair of the anchors in the plurality, being exterior anchors 110. One difference between the first and second pairs is that each interior anchor 108 of the first pair is of a first diametrical size, whereas each exterior anchor 110 of the second pair is of a second diametrical size greater than the first diametrical size, allowing the interior anchors 108 to fit within the exterior anchors 110. The anchors 108, 110 can be fabricated using well-known conventional molding techniques and known materials, such as, by way of example but not limitation, suitable plastic materials.

Each of the anchors 108, 110 of the first and second pairs thereof has a respective body 112, 114 and a respective attachment formation 116, 118 defined thereon. Each of the anchor bodies 112, 114 has the same general form of an endless rigid sidewall 120, 122, being, by way of example but not limitation, of a semi-spherical shape. Each of the sidewalls 120, 122 defines and surrounds an interior cavity 124, 126 in the body 112, 114. The sidewalls 120, 122 of each anchor 108, 110 has an endless rim 128, 130, being, by way of example but not limitation, of a circular shape. The attachment formations 116, 118 are defined on the sidewalls 120, 122 of the respective anchor 108, 110 opposite from the circular rims 128, 130 thereof. Each of the attachment formations 116, 118 is configured to couple with a respective one of several anchor connectors 132, 134 (to be described hereinafter with reference to FIGS. 5-10) being configured to engage with the sheet of material (beach towel) 104 on the sandy beach 106 so as to secure the sheet of material 104 thereon when the respective anchor body 112, 114 is buried in the sandy beach 106 such that the interior cavity 124, 126 of the respective anchor body 112, 114 is substantially filled with sand, below its respective circular rim 128, 130, as depicted in FIG. 10.

Figure 4:
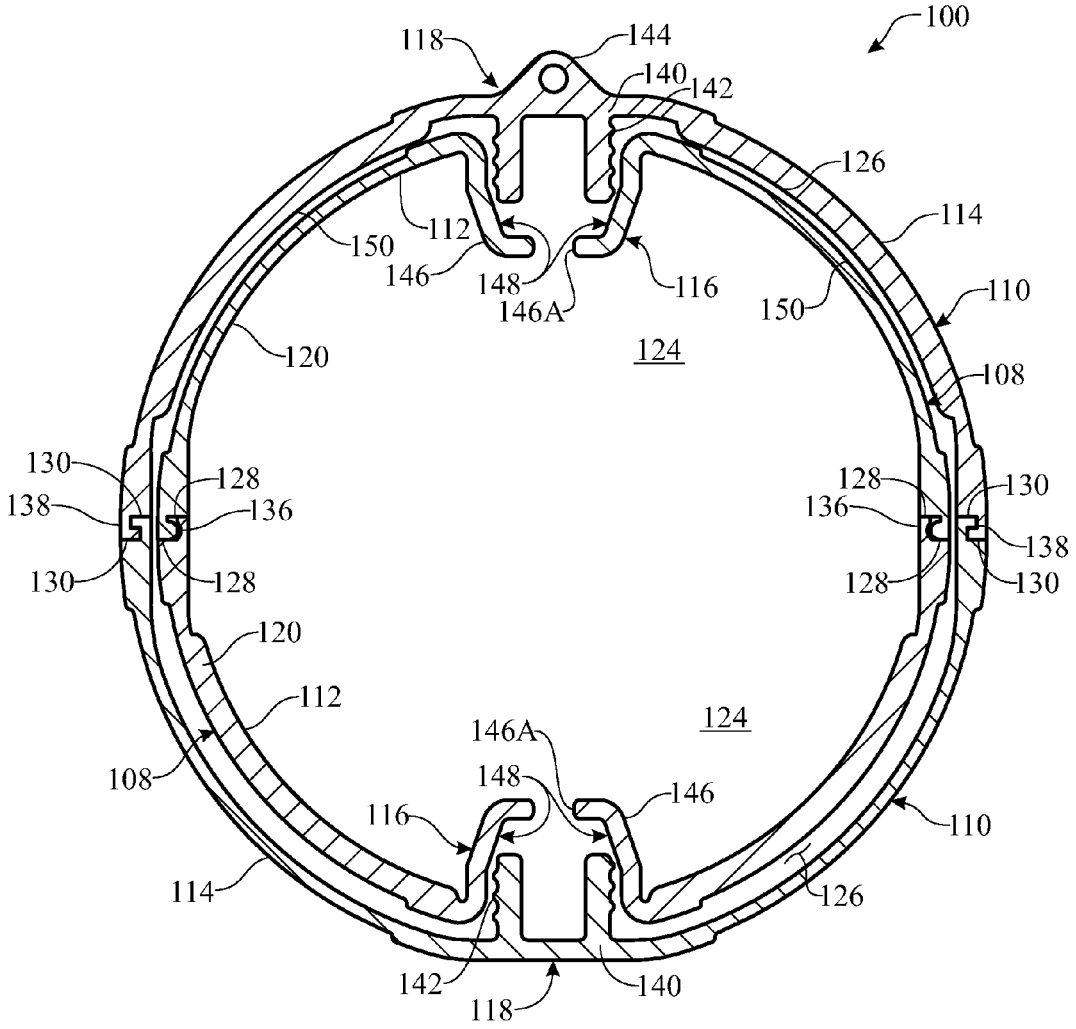
FIG. 4 presents a diametrical cross-sectional view of the anchors as originally introduced in FIG. 1 in their fully assembled configuration.
Figure 5:
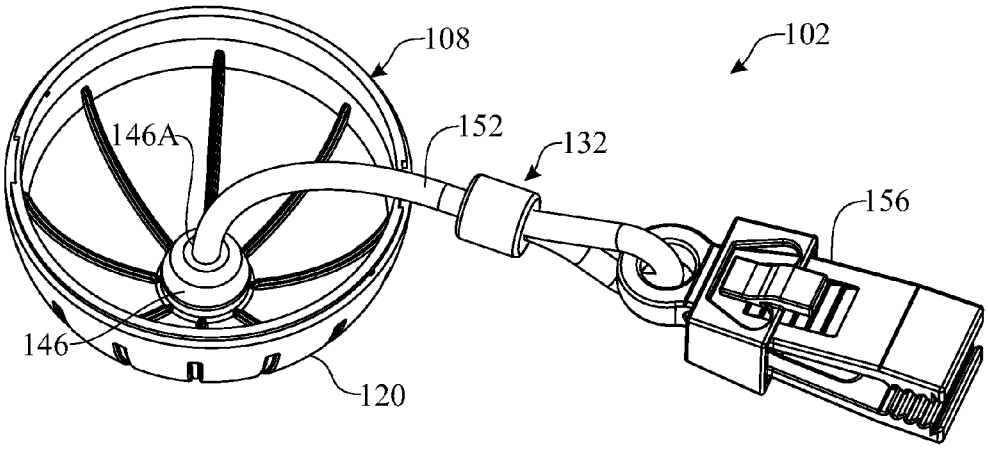
FIG. 5 presents a top isometric view of an exemplary embodiment of one of a plurality of anchor connectors of the anchorage system being associated with one of the interior anchors, the anchor connector having a flexible line permanently attached at one end to the interior anchor and a clamp coupled to the flexible line at an opposite end so as to enable the interior anchor of the anchorage system to be interconnected with at least a portion an item to be secured on the sandy beach.
Figure 6:
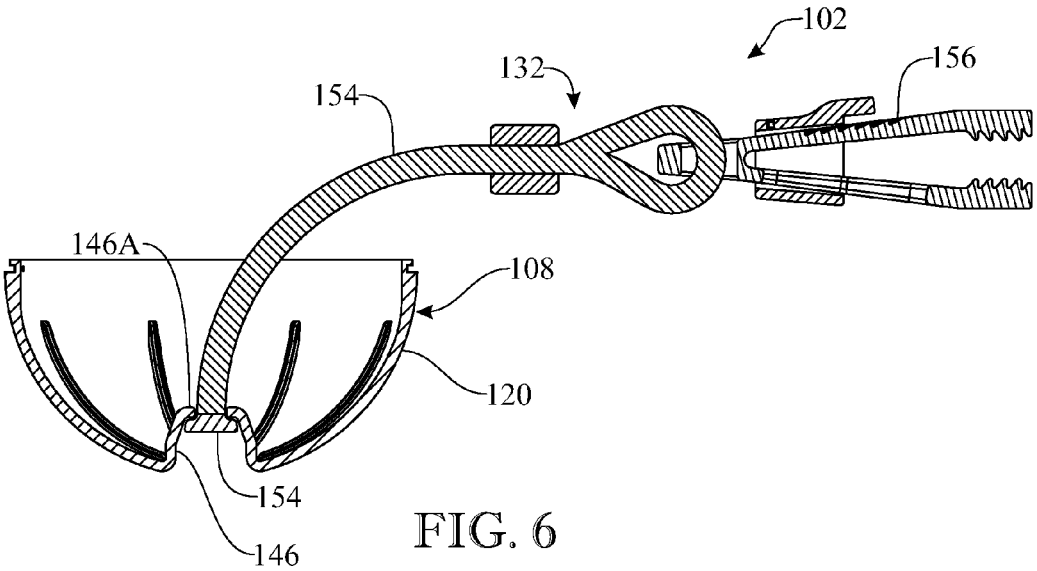
FIG. 6 presents a longitudinal sectional view of the interior anchor and the anchor connector of the anchorage system originally introduced in FIG. 5.
Figure 7:
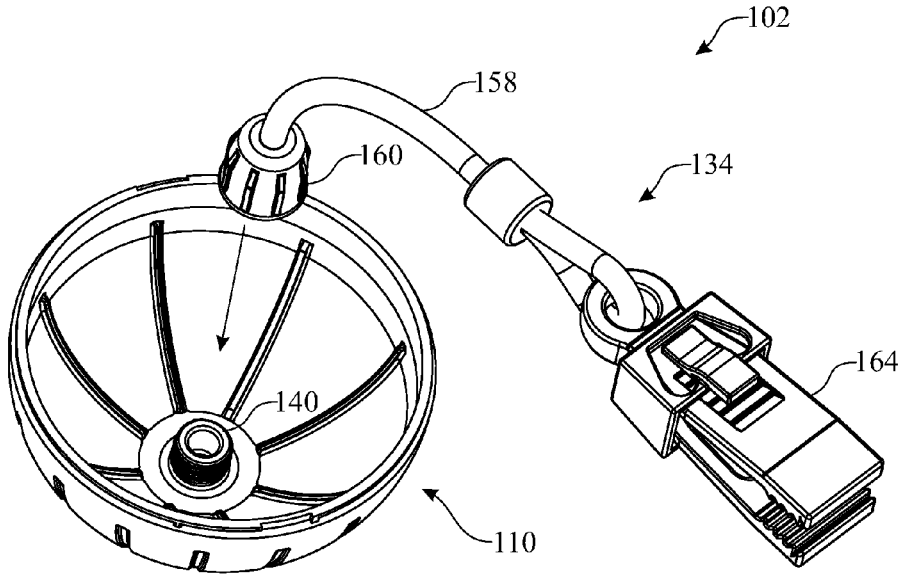
FIG. 7 presents a top isometric view of an exemplary embodiment of another of the plurality of anchor connectors of the anchorage system being associated with one of the exterior anchors, the anchor connector having a flexible linkage removably attached at one end to the exterior anchor and a clamp coupled to the flexible line at an opposite end so as to enable the exterior anchor of the anchorage system to be interconnected with at least a portion of an item to be secured on the sandy beach.
Figure 8:
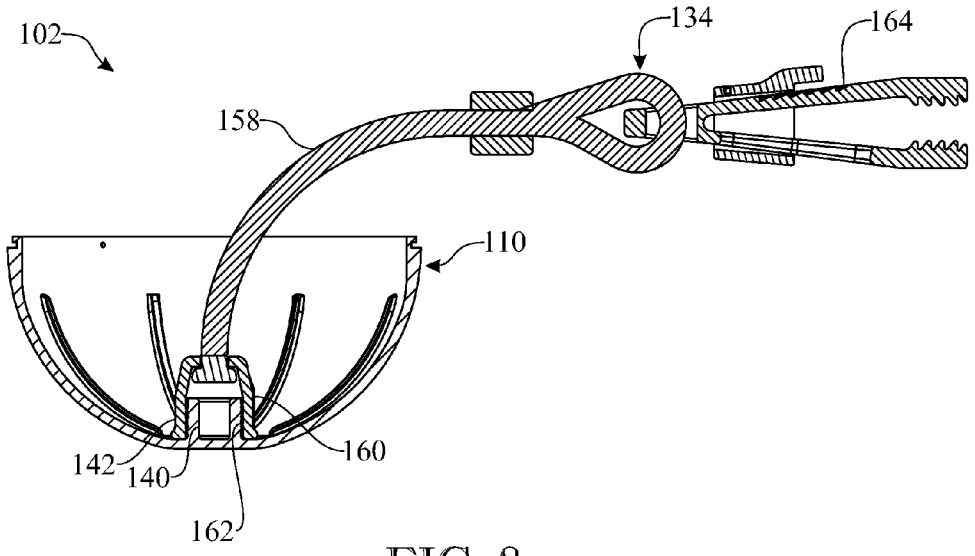
FIG. 8 presents a longitudinal sectional view of the exterior anchor and the anchor connector of the anchorage system originally introduced in FIG. 7.

As best shown in FIG. 4, the anchors 108, 110 at their respective circular rims 128, 130 are configured with complementary sets of mateable elements, being, by way of example but not limitation, threads 136, 138 defined thereon so as to enable the interior anchors 108 of the first pair to interengage with one another at the rims 128 and the exterior anchors 110 of the second pair to interengage with one another at the rims 130. The interengaged pair of interior anchors 108 and the interengaged pair of exterior anchors 110 respectively form single units having configurations, being, by way of example but not of limitation, in the shapes of globes, as seen in FIG. 4. The globe configurations have the two different diametrical sizes, in accordance with the different diametrical sizes of their respective anchors 108, 110, which enables fitting the first pair of interior anchors 108 into the second pair of exterior anchors 110, thereby facilitating their transport together to and from the sandy beach and their compact storage when not in use.

As also best shown in FIG. 4, another difference between the first and second pairs of anchors 108, 110 in the exemplary embodiment of the anchor assemblage 100 of FIGS. 1-4 is the respective configurations of the attachment formations 116, 118. In an exemplary embodiment, the attachment formation 118 on each of the exterior anchors 110 of the second pair thereof is a hub 140, being cylindrical shaped and formed on the anchor sidewall 122, opposite from the circular rim 130 thereof, so as to extend over a short distance into the interior cavity 126 of the anchor body 114. The hub 140 has a set of threads 142 defined about an exterior portion thereof. Also, on a base of the hub 140 at the exterior side thereof there is an eyelet 144 formed that projects a short distance away from the base of the hub 140 so as to permit attachment of a handle (not shown) or the like to facilitate handling or carrying the anchor assemblage 100. Further, the attachment formation 116 on each of the interior anchors 108 of the first pair thereof is an annular protuberance 146, being cylindrical shaped and formed on the anchor sidewall 120, opposite from the circular rim 128 thereof, so as to extend over a short distance into the interior cavity 124 of the anchor body 112 and define a recess 148 which is open at least from the exterior of the protuberance 146 and has sufficient depth so as to enable receipt of the hub 140 of an adjacent one the second pair of exterior anchors 110 into the recess 148 of the protuberance 146 of the respective interior anchor 108, as shown in FIG. 4. Also, at least the exterior anchors 110 of the second pair thereof have pluralities of ribs 150 that are formed in their anchor sidewalls 122 so as to extend into the interior cavities 126 of the anchor bodies 114 and between the circular rims 130 and the attachment formations 118 on the sidewalls 122 opposite from the circular rims 130. The ribs 150 on the interior of the exterior anchors 110 enable nesting of the interior anchors 108 of the first pair thereof within the exterior anchors 110 of the second pair thereof in a predetermined alignment of the first and second pairs with one another, as shown in FIG. 4.

Referring now to FIG. 5-10, there is illustrated the anchorage system 102, which was briefly referred to above, for securing the sheet of material 104, such as the beach towel, on the sandy beach 106, as shown in FIGS. 9 and 10. As seen in FIGS. 9*a* and 10, the anchorage system 102 includes the above-described anchor assemblage 100, being disassembled into the plurality of anchors 108, 110, and the plurality of anchor connectors 132, 134 which are of two slightly different configurations so as to attach to the anchors 108, 110. The anchor connectors 132, 134 engage the sheet of material 104 at respective ones of a plurality of corners 104A thereof so as to secure the sheet of material 104 on the sandy beach 106, once the anchor bodies 112, 114 are disposed, such as in inverted dome configurations, and buried in the sandy beach 106 such that the interior cavities 124, 126 of the anchor bodies 112, 114, below the circular rims 128, 130 thereof, are substantially filled with sand, as seen in FIG. 10.

As seen in FIGS. 5, 6, 9 and 10, the one anchor connector 132 has a flexible line 152 and is coupled to the annular protuberance 146 on the sidewall 120 of the interior anchor 108 by a plug 154 attached, either removably or permanently, to one end of the flexible line 152, so as to close an aperture 146A in the annular protuberance 146. The flexible line may be, by way of example but not limitation, a cord or cable. The anchor connector 132 also includes a clamp 156 coupled to another end of the flexible line 152 opposite from the one end. The clamp 156 is configured to detachably grasp a portion of the item, such as one of the corners 104A of the sheet of material 104, so as to secure the item on the sandy beach 106.

As seen in FIGS. 7-10, the anchor connector 134 also has a flexible line 158 and is coupled to the hub 140 on the sidewall 122 of the exterior anchor 110 by a socket 160 attached, either removably or permanently, to one end of the flexible line 158. The flexible line 158 may be, by way of example but not limitation, a core or cable. The socket 160 has an internal set of threads 162 being detachably attachable to the external set of threads 142 on the hub 140 on the anchor sidewall 122. The anchor connector 134 also includes a clamp 164 coupled to another end of the flexible line 158 opposite from the one end. The clamp 164 is configured to detachably grasp a portion of the item, such as one of the corners 104A of the sheet of material 104, so as to secure the item on the sandy beach.

Figure 11:
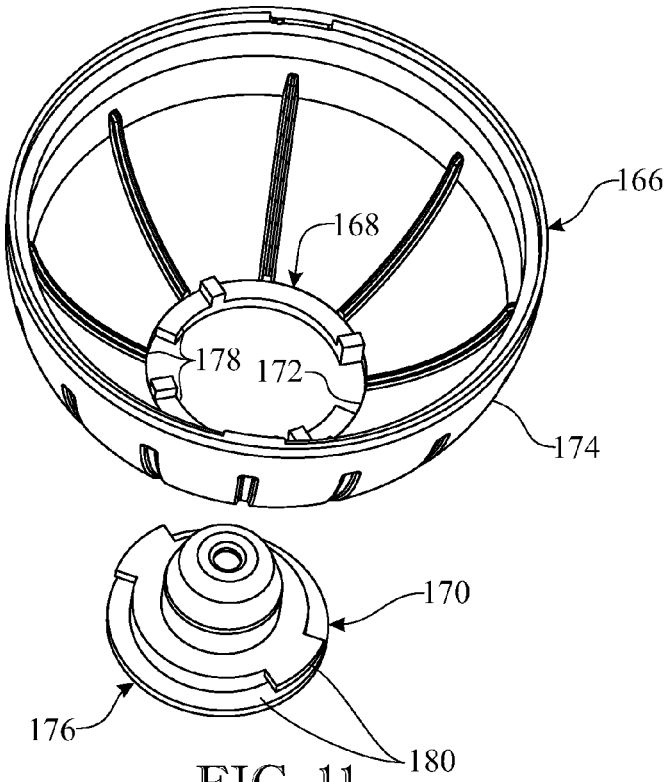
FIG. 11 presents a top isometric view of an alternative embodiment of an exterior anchor used in alternative anchorage systems of FIGS. 14-16 and FIGS. 17-20, the exterior anchor being shown separated from a removable cap that adapts the exterior anchor to also be used with the exemplary embodiment of the anchorage system of FIGS. 7-9.
Figure 12:
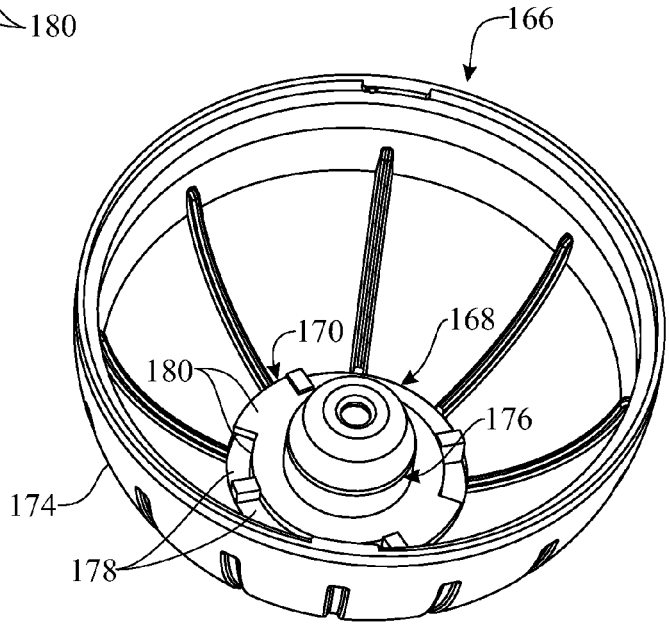
FIG. 12 presents a top isometric view of the exterior anchor originally introduced in FIG. 11, with the removable cap being shown installed in the exterior anchor.
Figure 13:
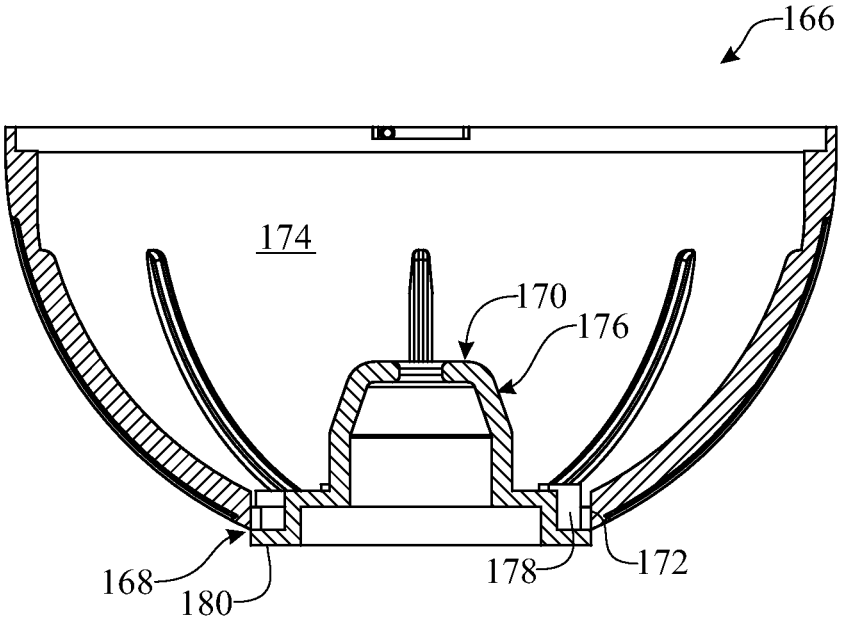
FIG. 13 presents a diametrical cross-sectional view of the exterior anchor installed with the removable cap, as originally presented in FIG. 12.

Referring now to FIGS. 11-13, there is illustrated an alternative embodiment of an anchor 166 which, except as described below, has the same features and configuration as either of the interior or exterior anchors 108, 110, as described previously above. The alternative anchor 166 is able to function similar to either the interior anchor 108 or the exterior anchor 110. The difference between the alternative anchor 166 and the interior and exterior anchors 108, 110 lies in the configurations of the attachment formations 168, 170 respectively defined about a central opening 172 on a sidewall 174 of the anchor 166 and on a cap 176 that enables the cap 176 to interengage with the anchor sidewall 174 at the central opening 172. The attachment formations 168, 170 on the anchor sidewall 174 and on the cap 176 are defined by respective sets 178, 180 of protrusions and recesses that are complementary to one another so as to enable the cap 176 to couple with, and decouple from, the anchor sidewall 174. The alternative anchor 166 with the cap 176 removed can replace the exterior anchor 110 in the anchor assemblage 100. The alternative anchor 166 with the cap 176 can replace the interior anchor 108 in the anchor assemblage 100.

Referring now to FIGS. 14-20, there is illustrated several alternative embodiments of anchorage systems 182, 184 for securing differing items on a sandy beach. The alternative systems 182, 184 employs the one alternative anchor 166, as just described above, and a respective one of the alternative anchor connectors 186, 188 each having the same attachment formation 170, as that described above on the cap 176, being coupled to the attachment formation 168 on the sidewall 174 of the alternative anchor 166 so as to close the central opening 172 to the interior cavity 190 in the anchor sidewall 174.

Figure 14:
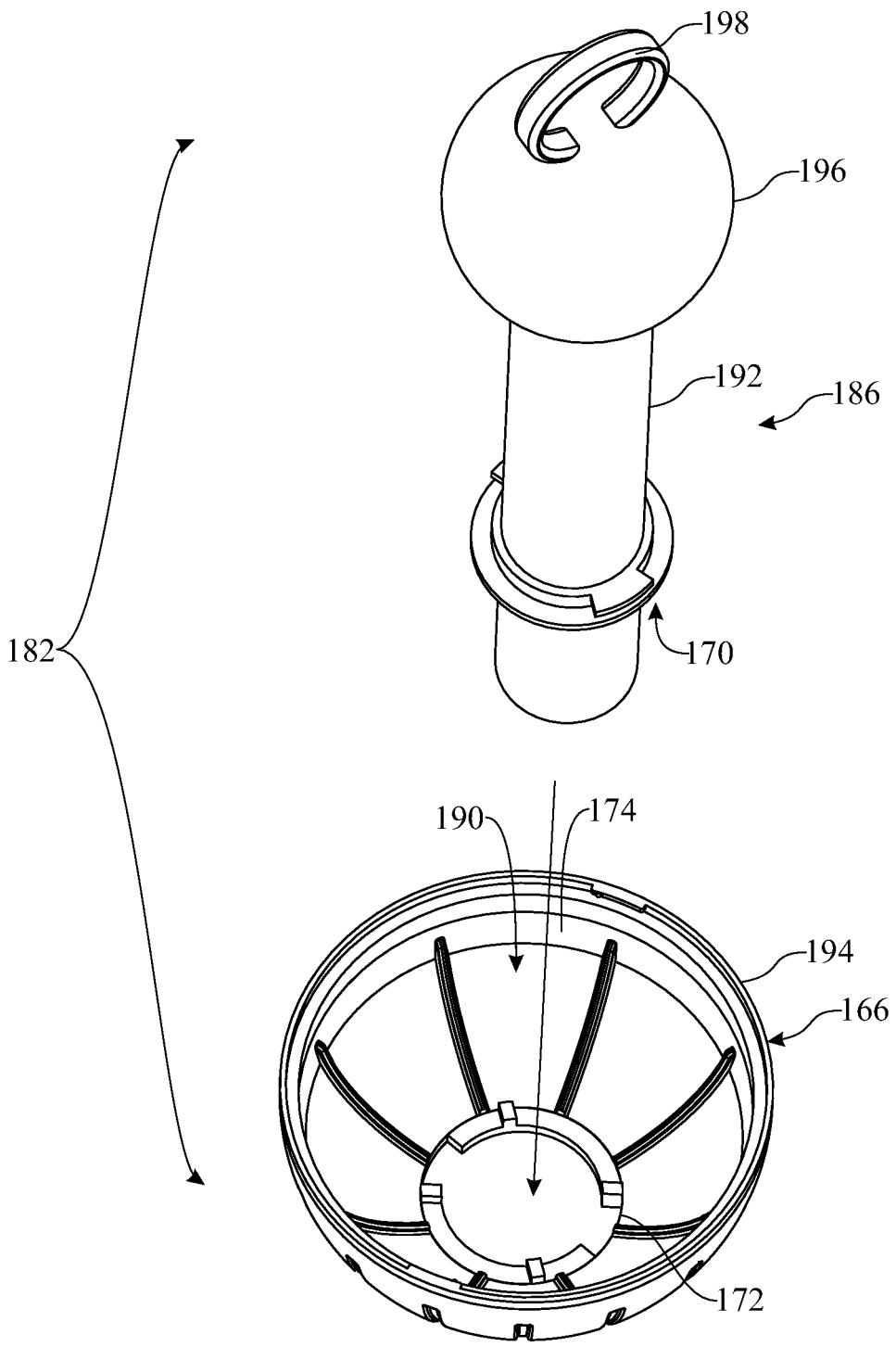
FIG. 14 presents a top isometric disassembled view of the one alternative anchorage system using the alternative embodiment of the exterior anchor originally introduced in FIG. 11.
Figure 15:
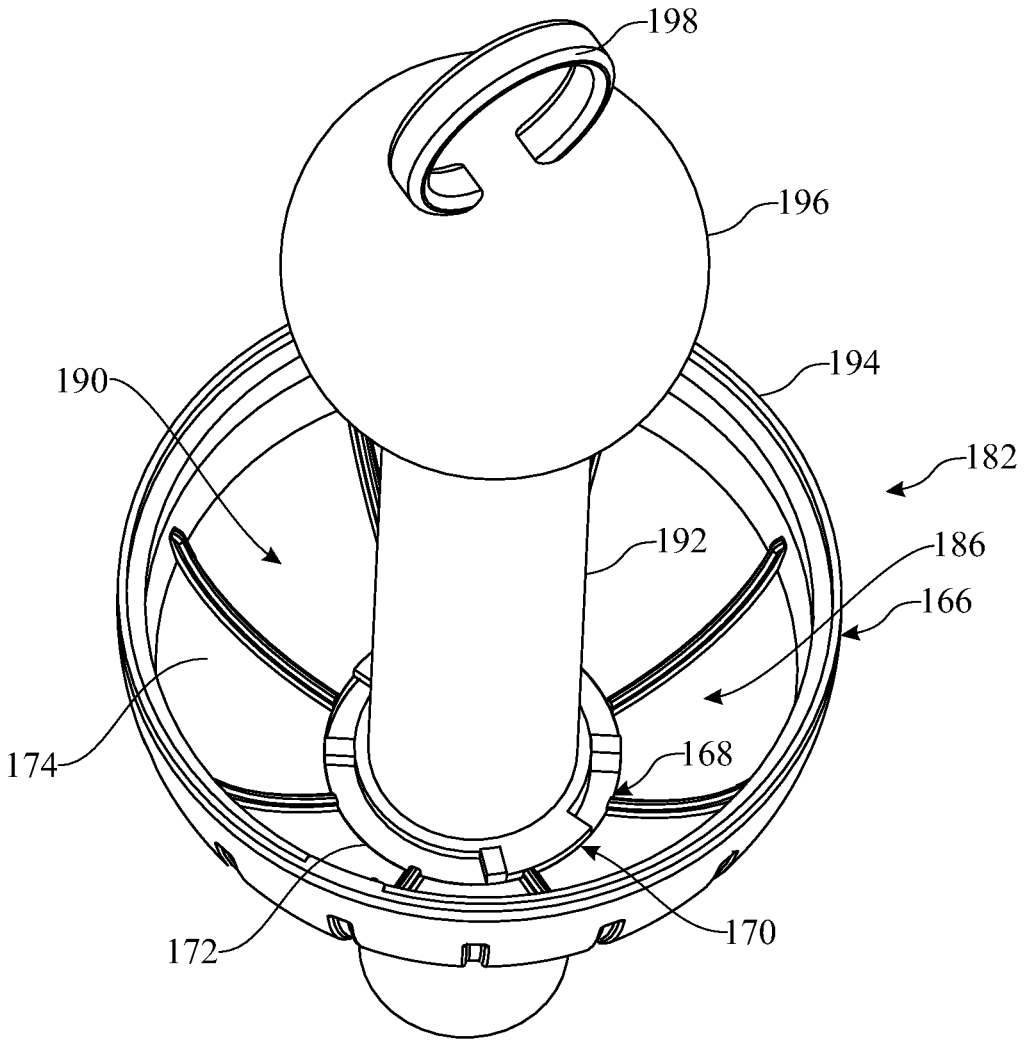
FIG. 15 presents a top isometric assembled view of the one alternative anchorage system originally introduced in FIG. 14.
Figure 16:
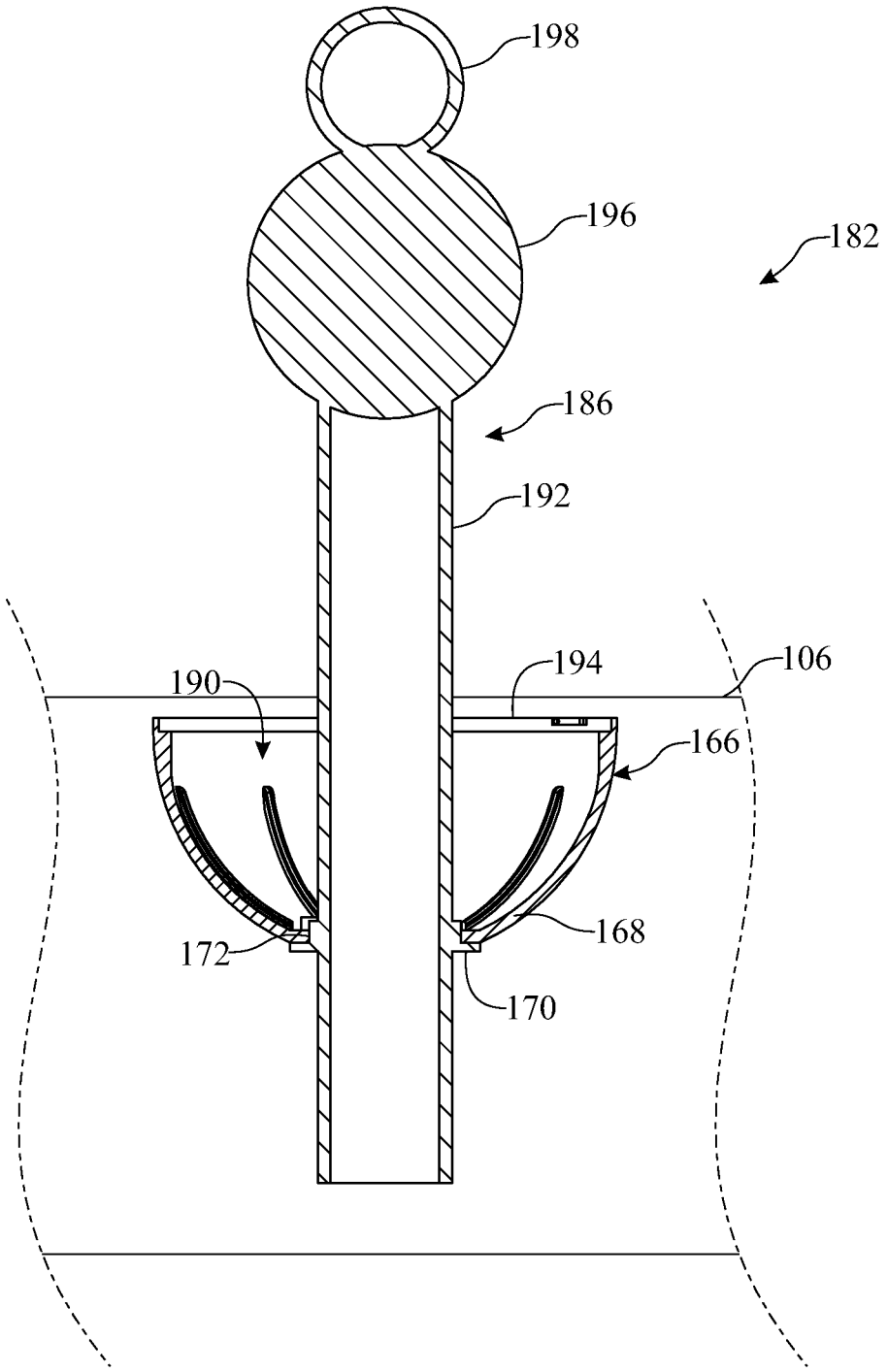
FIG. 16 presents a longitudinal sectional view of the one alternative anchorage system originally introduced in FIG. 15.
Figure 17:
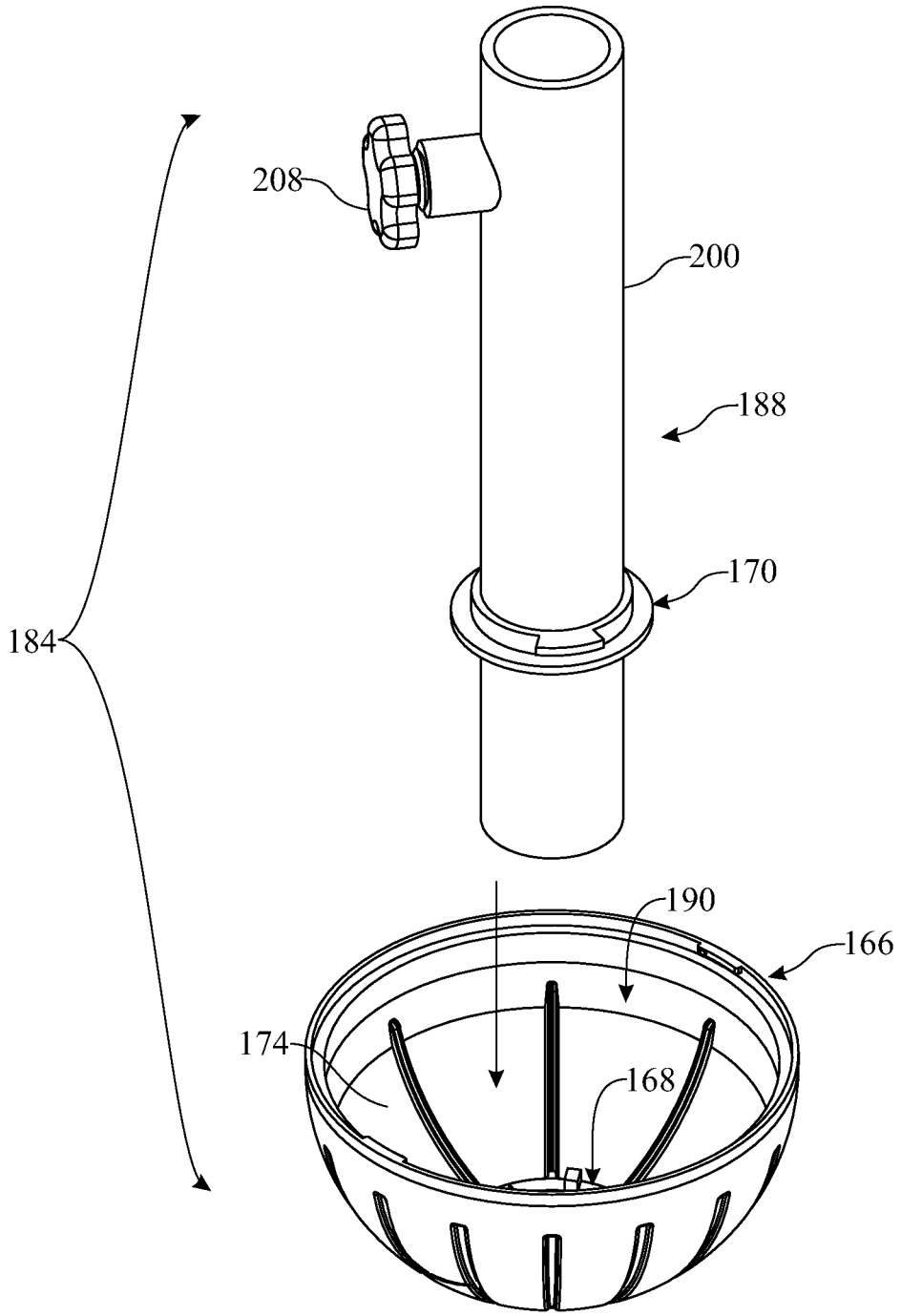
FIG. 17 presents a top isometric disassembled view of the other alternative anchorage system using the alternative embodiment of the exterior anchor originally introduced in FIG. 11.
Figure 18:
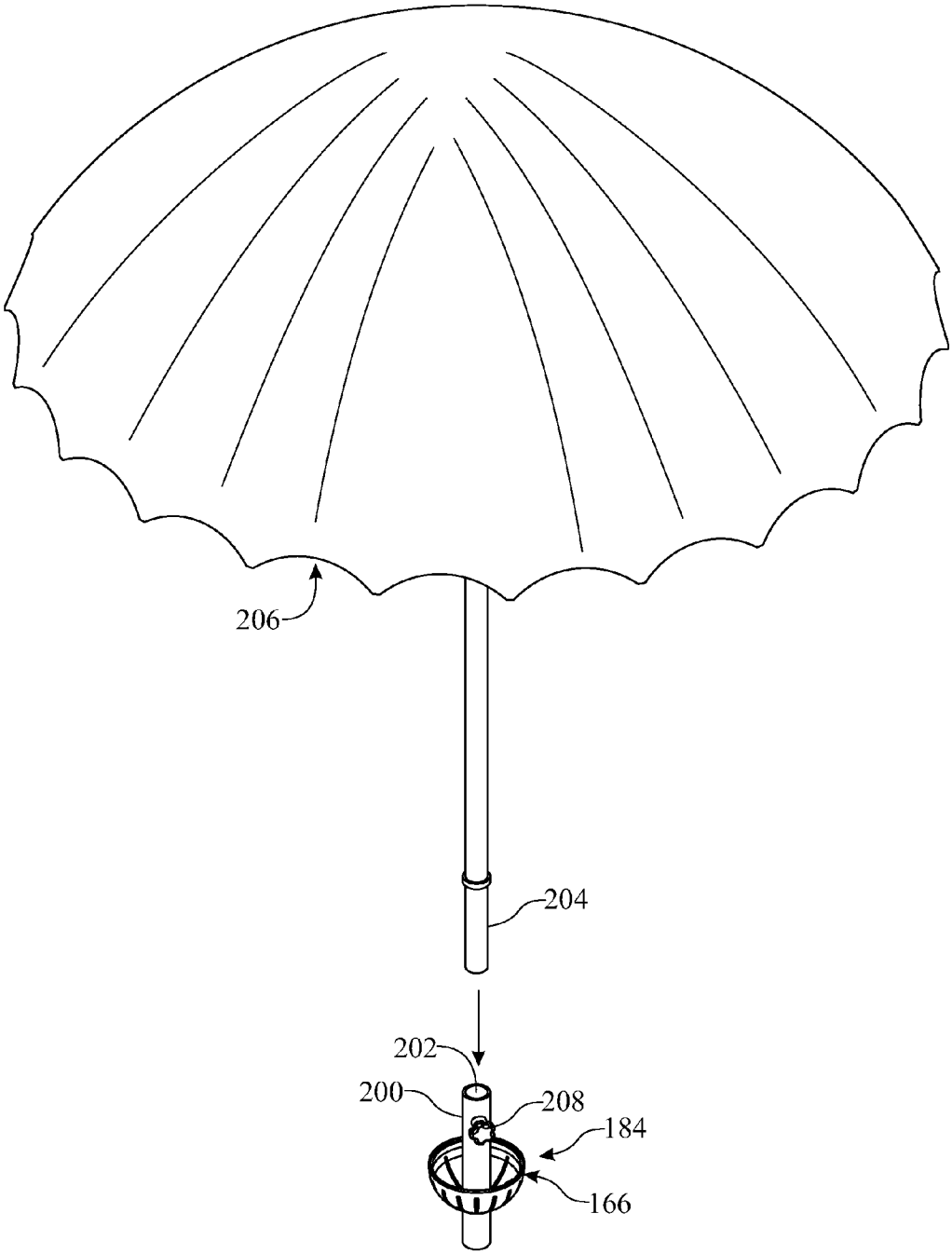
FIG. 18 presents a top isometric assembled view of the other alternative anchorage system originally introduced in FIG. 17, being shown disassembled from a beach umbrella.
Figure 19:
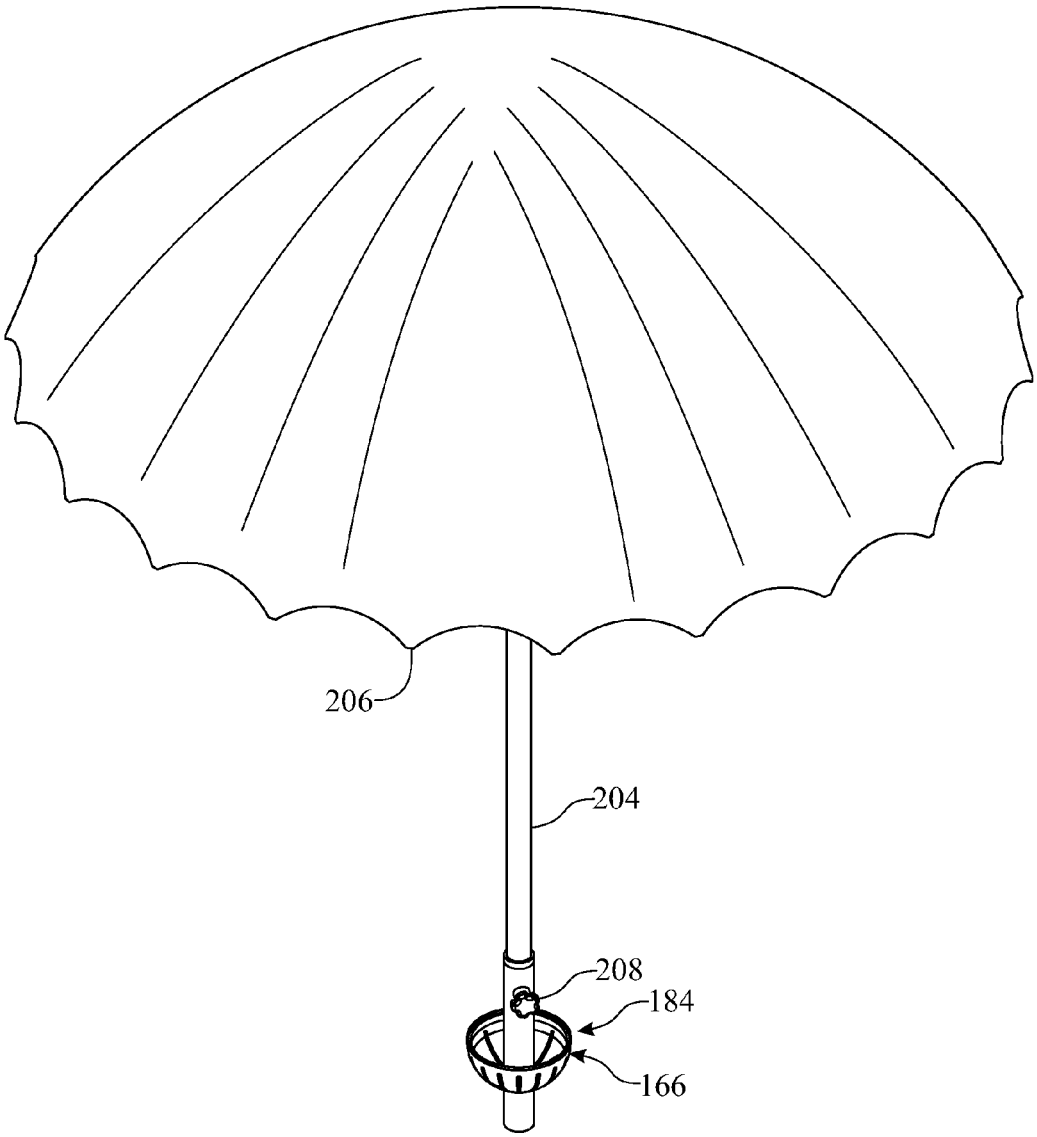
FIG. 19 presents a top isometric assembled view of the other alternative anchorage system of FIG. 18, being shown assembled with the beach umbrella.
Figure 20:
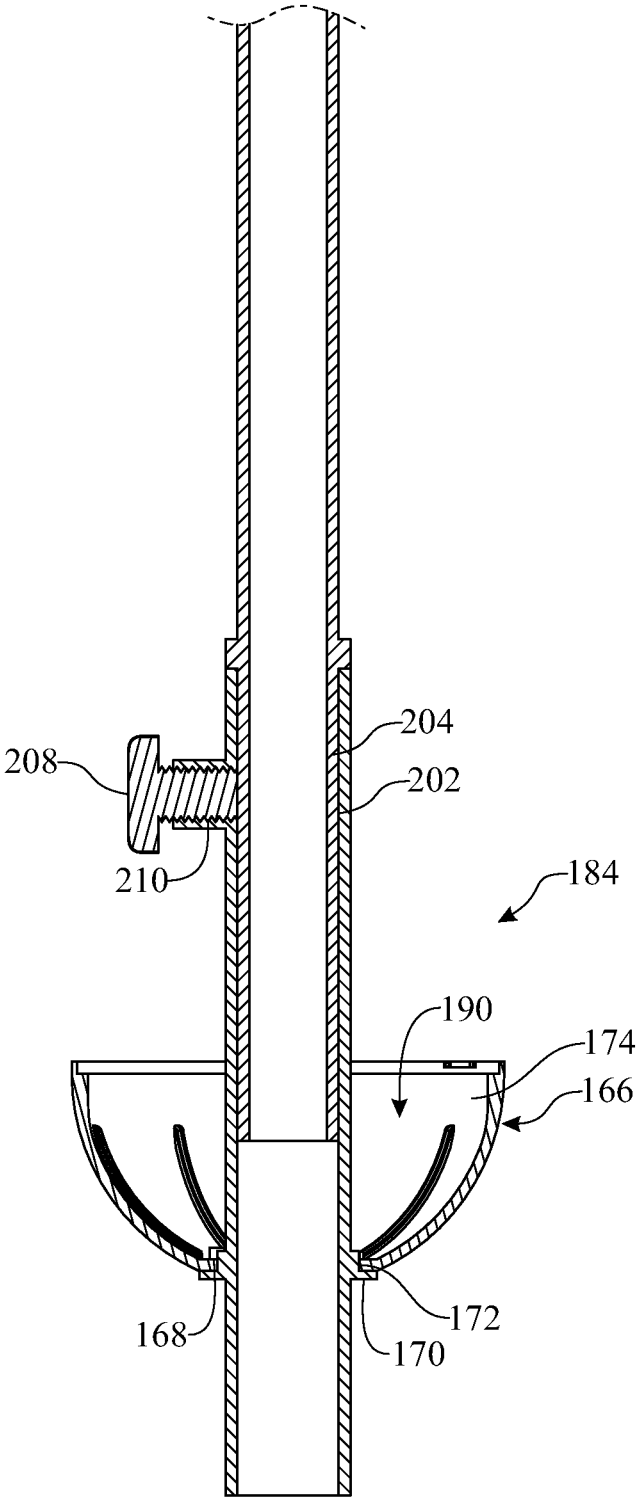
FIG. 20 presents a longitudinal sectional view of the other alternative anchorage system assembled with the beach umbrella as originally introduced in FIG. 19, with only an end portion of a pole of the beach umbrella being illustrated.

As seen in FIGS. 14-16, the anchor connector 186 of the one anchorage system 182 includes an elongated sleeve 192 extending through the central opening 172 and interior cavity 190 in the anchor sidewall 174 of the alternative anchor 166. The elongated sleeve 192 proximate to one end has thereon the attachment formation 170, same as that described above on the cap 176, which interengages with the attachment formation 168 on the anchor sidewall 174 about its central opening 172. The elongated sleeve 192 extends beyond the circular rim 194 of the anchor sidewall 174 to another end, being opposite to the one end, at which is mount an object 196 having, by way of example but not limitation, a spherical shape, or being in a shape different than the sleeve 192, and a hook element 198 thereon being exposed above the sandy beach 106 for attachment of another item thereto, such as a pet leash, when the anchor 166 is disposed in an inverted dome configuration and buried in the sandy beach such that the interior cavity 190 of the sidewall 174, below the circular rim 194 thereof, is substantially filled with sand, as seen in FIG. 16.

As seen in FIGS. 17-20, the anchor connector 188 of the other anchorage system 184 also includes an elongated sleeve 200 extending through the central opening 172 and interior cavity 190 in the anchor sidewall 174 of the alternative anchor 166. The elongated sleeve 200 proximate to one end has thereon the attachment formation 170, same as that described above on the cap 176, which interengages with the attachment formation 168 on the anchor sidewall 174 about its central opening 172. The elongated sleeve 200 extends beyond the circular rim 194 of the anchor sidewall 174 to another end, being opposite to the one end. The elongated sleeve 200 defines a hollow interior 202 configured for receiving an end portion of pole 204 of a beach umbrella 206 therethrough and into the hollow interior 202 thereof. The anchor connector 188 also has a knob 208 threaded through a threaded opening 210 in a side of the elongated sleeve 200 for tightening and loosening against the end portion of the pole 204 of the beach umbrella 206 for securing and releasing the pole 204 to and from the elongated sleeve 200.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. An anchor assemblage, comprising:

a plurality of anchors, each anchor comprising a body in the form of an endless rigid sidewall defining and surrounding an interior cavity in said body, said sidewall having an endless rim, and an attachment formation on said sidewall opposite from said endless rim for coupling with an anchor connector configured to engage with an item on a sandy beach so as to secure the item on the sandy beach when said anchor body is buried in the sandy beach such that said interior cavity of said anchor body, below said endless rim thereof, is substantially filled with sand;

wherein said plurality of anchors form the anchor assemblage including a first pair of anchors and a second pair of anchors, each anchor of said first pair being of a first size and each anchor of said second pair being of a second size greater than said first size, said anchors of said first pair at said endless rims thereof being complementarily configured so as to enable said anchors of said first pair to interengage with one another at the endless rims thereof and said anchors of said second pair at said endless rims thereof being complementarily configured so as to enable said anchors of said second pair to interengage with one another at the endless rims thereof such that said first and second interengaged pairs of anchors respectively form into configurations of two different sizes which enable fitting said first pair of anchors into said second pair of anchors for facilitating transport of the first and second pairs of anchors together, to and from the sandy beach, and facilitating compact storage of said anchor assemblage when not in use.

2. The anchor assemblage of claim 1 wherein said endless rims of said sidewalls of said first and second pairs of said anchors have complementary sets of threads defined thereon that enable said anchors of a respective pair thereof to interengage with one another.

3. The anchor assemblage of claim 1 wherein said anchors of said second pair thereof have pluralities of ribs formed on said sidewalls thereof so as to extend into said interior cavities of said anchor bodies and between said endless rims and said attachment formations on said sidewalls opposite from said endless rims, said ribs enabling nesting of said first pair of said anchors within said second pair of said anchors in a predetermined alignment of said first and second pairs with one another.

4. The anchor assemblage of claim 1 wherein said attachment formation on each of said anchors of said first pair thereof is an annular protuberance formed on said anchor sidewall opposite from said endless rim so as to extend into said interior cavity of anchor body, said protuberance having an aperture in an end portion thereof.

5. The anchor assemblage of claim 1 wherein said attachment formation on each of said anchors of said second pair thereof is a hub formed on said anchor sidewall opposite from said endless rim so as to extend into said interior cavity of said anchor body, said hub having a set of threads about an exterior portion thereof.

6. The anchor assemblage of claim 5 wherein said attachment formation on each of said anchors of said first pair thereof is an annular protuberance formed on said anchor sidewall opposite from said endless rim so as to extend into said interior cavity of said anchor body and receive said hub of an adjacent one said second pair of said anchors.

7. The anchor assemblage of claim 6 wherein said anchors of said second pair thereof have pluralities of ribs formed in said sidewalls thereof so as to extend into said interior cavities of said anchor bodies and between said endless rims and said attachment formations on said sidewalls opposite from said endless rims, said ribs enabling nesting of said first pair of said anchors within said second pair of said anchors in a predetermined alignment of said first and second pairs with one another.

8. The anchor assemblage of claim 1 wherein each of said endless sidewalls of said anchor bodies is semi-spherical shaped, each of said endless rims is circular shaped, and each of said interengaged anchors of said first and second pairs respectively form into configurations of globes having said two different sizes.

9. An anchorage system, comprising:

a plurality of anchors, each anchor comprising a body having an endless rigid sidewall defining and surrounding an interior cavity in said body, said sidewall having an endless rim, and an attachment formation on said endless sidewall opposite from said endless rim; and a plurality of anchor connectors each being configured to couple with one of said attachment formations on said sidewalls of said anchors and to engage a sheet of material at one of a plurality of corners of said sheet, so as to secure the sheet of material upon a sandy surface when said anchor bodies are buried in the sandy beach such that said interior cavities of said anchor bodies, below said endless rims thereof, are substantially filled with sand;

wherein said plurality of anchors form an anchor assemblage including a first pair of anchors and a second pair of anchors, each anchor of said first pair being of a first size and each anchor of said second pair being of a second size greater than said first size, said anchors of said first pair at said endless rims thereof being complementarily configured so as to enable said anchors of said first pair to interengage with one another at the endless rims thereof and said anchors of said second pair at said endless rims thereof being complementarily configured so as to enable said anchors of said second pair to interengage with one another at the endless rims thereof such that said first and second interengaged pairs of anchors respectively form into configurations of two different sizes which enable fitting said first pair of anchors into said second pair of anchors for facilitating transport together to and from the sandy beach and compact storage when not in use.

10. The anchorage system of claim 9 wherein each of said endless sidewalls of said anchor bodies is semi-spherical shaped, each of said endless rims is circular shaped, and each of said interengaged anchors of said first and second pairs respectively form into configurations of globes having said two different sizes.

11. An anchorage system, comprising:

at least one anchor, said anchor comprising a body having an endless rigid sidewall defining and surrounding an interior cavity in said body, said sidewall having an endless rim and a central opening opposite from said endless rim, and an attachment formation on said sidewall extending about said central opening therein; and at least one anchor connector, said anchor connector being configured to couple at one end to said attachment formation on said anchor sidewall so as to close said central opening in said anchor sidewall and extend through said interior cavity of said anchor body to outwardly beyond said endless rim of said anchor sidewall, said anchor connector also being configured to engage with an item so as to secure the item on a sandy beach when said anchor body is buried in the sandy beach such that said interior cavity of said anchor body, below said endless rim thereof, is substantially filled with sand.

12. The anchorage system of claim 11 wherein:

said attachment formation includes an annular cap being attached, one of either removably or permanently, to and extending about said central opening of said anchor sidewall, said annular cap having an aperture; and said anchor connector includes a flexible line having a plug on one end thereof being attached, one of either removably or permanently, to said annular cap so as to close said aperture of said annular cap.

13. The anchorage system of claim 12 wherein said anchor connector also includes a clamp coupled to another end of said flexible line opposite from said one end, said clamp being configured to detachably grasp a portion of the item so as to secure the item on the sandy beach.

14. The anchorage system of claim 11 wherein:

said attachment formation includes a hub formed on said anchor sidewall about said central opening therein and extending within said interior cavity of said anchor body, said hub having an exteriorly-threaded portion; and said anchor connector includes a flexible line having a socket on one end thereof, said socket having an internally-threaded portion being detachably attachable to said exteriorly-threaded portion of said hub on said anchor sidewall.

15. The anchorage system of claim 14 wherein said anchor connector also includes a clamp coupled to another end of said flexible line opposite from said one end, said clamp being configured to detachably grasp a portion of the item so as to secure the item on the sandy beach.

16. The anchorage system of claim 11 wherein said anchor connector includes an elongated sleeve having another end, being opposite to said one end, mounting an object at said another end being different in shape than said sleeve and having a hook element thereon being exposed above the sandy beach for attachment of another item thereto when said anchor body is buried in the sandy beach.

17. The anchorage system of claim 11 wherein said anchor connector includes an elongated sleeve having another end being opposite to said one end, said elongated sleeve defining a hollow interior configured for receiving an end portion of pole of a beach umbrella through said another end and into said hollow interior of said elongated sleeve, said anchor connector also having knob threaded through a threaded opening in a side of said elongated sleeve for tightening and loosening against the end portion of the pole of the beach umbrella for securing and releasing the pole to and from said elongated sleeve.

18. The anchorage system of claim 11 wherein said anchor connector at said one end and said attachment formation about said central opening on said anchor sidewall have sets of protrusions and recesses defined thereon that are complementary to one another so as to enable said anchor connector to couple with said attachment formation.

19. The anchorage system of claim 11 wherein said endless sidewall of said anchor body is semi-spherical shaped and said endless rim on said endless sidewall is circular shaped.

* * * * *